US005765726A

United States Patent [19]

Jones

[11] Patent Number: 5,765,726

[45] Date of Patent: Jun. 16, 1998

[54] COMBINED CARBONATED AND NON-CARBONATED BEVERAGE DISPENSER

[75] Inventor: Brian C. Jones, Collinsville, Conn.

[73] Assignee: IMI Wilshire Inc., Anoka, Minn.

[21] Appl. No.: 534,832

[22] Filed: Sep. 27, 1995

[51] Int. Cl.[6] ..... B67D 5/56

[52] U.S. Cl. ..... 222/129.1; 222/64

[58] Field of Search ..... 222/64, 129.1, 222/129.2, 129.3, 129.4

[56] References Cited

U.S. PATENT DOCUMENTS

| | | | |
|---|---|---|---|
| 3,853,244 | 12/1974 | Neumann | 222/129.1 |
| 4,520,950 | 6/1985 | Jeans | 222/129.1 |
| 4,804,112 | 2/1989 | Jeans | 222/129.1 |
| 5,033,645 | 7/1991 | Shannon et al. | 222/61 |
| 5,086,951 | 2/1992 | Nakayama et al. | 222/129.1 |
| 5,464,124 | 11/1995 | Weyh et al. | 222/129.1 |
| 5,538,160 | 7/1996 | Ziesel | 222/129.1 X |
| 5,553,746 | 9/1996 | Jones . | |

FOREIGN PATENT DOCUMENTS

| | | | |
|---|---|---|---|
| 9405591 | 3/1994 | WIPO | 222/129.1 |

*Primary Examiner*—Joseph Kaufman
*Attorney, Agent, or Firm*—Vickers Daniels & Young

[57] ABSTRACT

A beverage dispenser with a carbonator and water pump provides improved flow of water for dispensing non-carbonated drinks. When a non-carbonated drink is dispensed a valve in a pump bypass line opens allowing water to flow around the pump rather than through it.

10 Claims, 1 Drawing Sheet

COMBINED CARBONATED AND NON-CARBONATED BEVERAGE DISPENSER

BACKGROUND OF THE INVENTION

Figure 1:
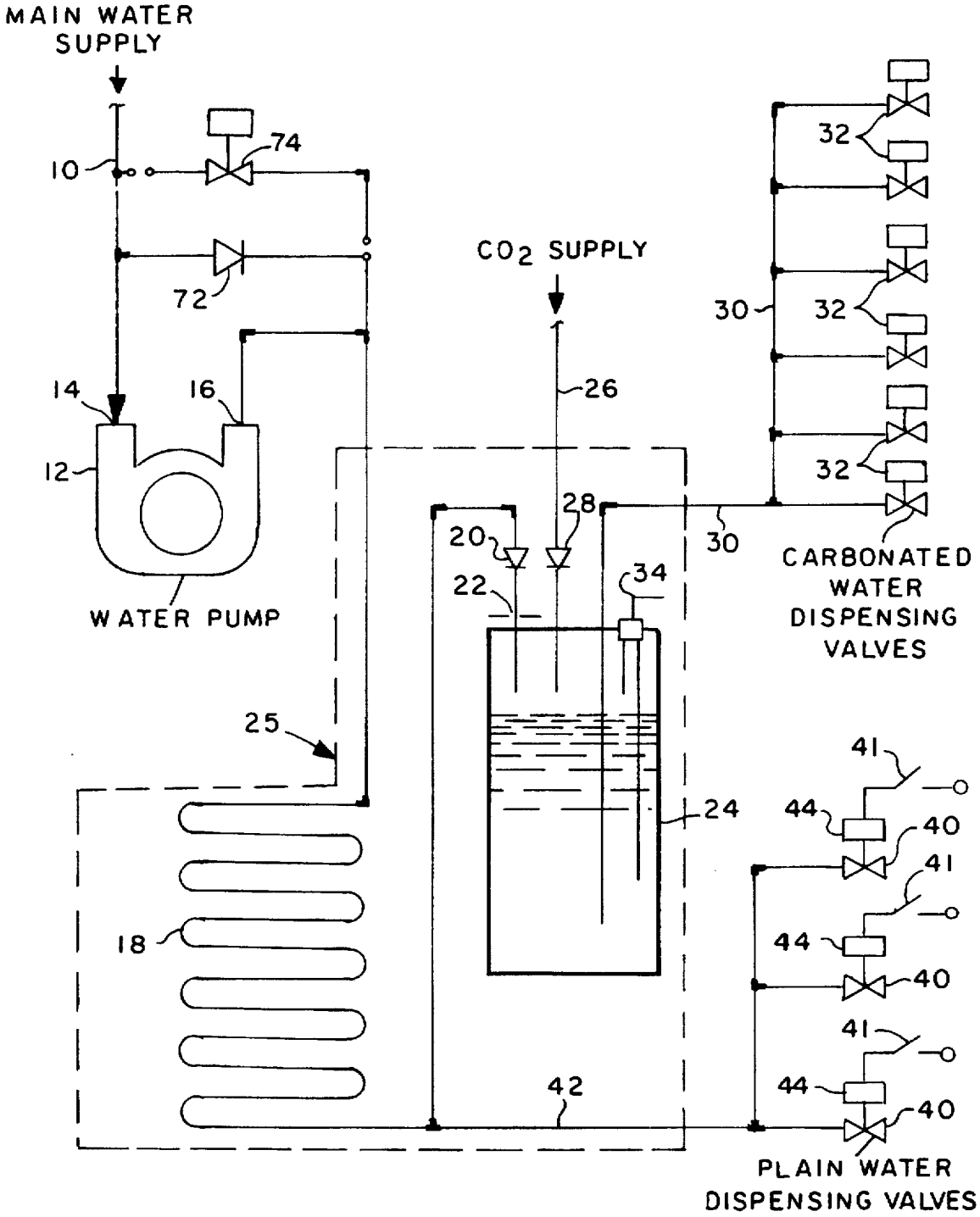

The present invention relates to a beverage dispenser for the dispensing of non-carbonated beverages and carbonated beverages from the same appliance. More specifically, the present invention relates to assemblies for dispensing non-carbonated drinks at a reasonable rate with good quality from an appliance having multiple plain water drink dispensing valves and carbonated water dispensing valves.

Some types of post mixed beverage dispensers include means of chilling water and syrup, a carbonator for making carbonated water from plain water and dispensing valves which mix syrup with carbonated water or plain water and dispense them into cups for consumers. The carbonator often comprises a tank into which plain water (often referred to as sweet water) and carbon dioxide are introduced. The carbon dioxide enters into solution in the water forming carbonated water. The sweet water is often chilled prior to introduction into the carbonator tank as carbonation takes place more efficiently in chilled water. Both the water and the carbon dioxide are introduced into the tank under pressure. The tank pressure is approximately the same as the carbon dioxide supply pressure, typically 75 lbs/in$^2$. This is normally accomplished for the water by means of a carbonator water pump which is often physically closely associated with the carbonator tank itself. Sweet water is provided to the pump, is pressurized and then injected into the carbonator tank at a pressure greatly in excess of 75 lbs/in$^2$. The high sweet water inlet pressure is needed to overcome the flow resistance of an inlet orifice which creates a high velocity water stream to promote carbonation through resultant turbulent mixing inside the tank. Carbonated water is withdrawn from the tank, sometimes further chilled, mixed with syrup and dispensed with the dispensing valves as a carbonated finished drink.

It is often desirable to also dispense non-carbonated drinks from the same beverage dispenser. Such non-carbonated drinks can be plain water or water mixed with a flavoring or fruit based syrup as the retailer desires. In the past, water flowed from the main supply, through a carbonator pump, through a chilling tube to the plain water valve. While this arrangement works well in many applications, problems have been encountered.

In appliances such as the one described above, the water pump is turned on to fill the carbonator tank. Water for a plain water drink flows through the deenergized pump which results in a significant loss of water pressure across the pump. If more than one plain water valve is opened at once, pressure loss across the deenergized pump is greatly increased and the resultant flow rate of water to the beverage dispensing valves may be low. This low water flow rate may cause improper proportions of syrup and water to be dispensed resulting in a poor quality beverage.

THE INVENTION

In accordance with the invention, there is provided a carbonated and non-carbonated beverage dispenser having a water pump; a carbonator receiving pressurized water from the water pump, carbonated beverage dispensing valves receiving carbonated water from the carbonator, which mix this carbonated water and syrup to dispense it as a mixed drink; non-carbonated beverage dispensing valves; and, a check valve bypassing the pump adapted to maintain the pressure and flow rate of water received by the non-carbonated beverage dispensing valves at an appropriate pressure and flow rate.

Further in accordance with the invention, the bypass check valve is a low pressure loss high flow rate check valve.

Still further in accordance with the invention a water circuit for a beverage dispenser is provided in which water flows from a main water inlet into either a pump or a bypass valve connected parallel to the pump, into a chilling tube and from the chilling tube into either a carbonator or to one or more plain water dispensing valves.

It is the primary object of the present invention to provide a beverage dispenser capable of dispensing plain water drinks at a correct pressure level and flow rate and also capable of dispensing carbonated beverages.

It is another object of the present invention to provide a beverage dispenser which can dispense two or more non-carbonated beverages at the same time at desired pressure and flow rates.

It is yet another object of the present invention to provide a beverage dispenser using a common chill path for plain water to be used in plain water drinks or for plain water to be carbonated.

It is another object of the present invention to provide a beverage dispenser in which the flow restriction of the carbonator pump may be bypassed when deenergized or when the dispensing flow demand exceeds the pump flow capacity.

It is still another object of the present invention to provide a plain water and carbonated drink beverage dispenser which is inexpensive to manufacture, inexpensive to operate and provides a compact design.

It is yet another object of the present invention to provide a beverage dispenser having improved non-carbonated beverage dispensing characteristics which is installed in a manner identical to a conventional dispenser whereby training costs are minimized.

The invention may take physical form in certain parts and arrangements of parts, a preferred embodiment of which will be described in detail in this specification and illustrated in the accompanying drawings which form a part hereof and wherein:

FIG. 1 schematically illustrates the water carrying components and mechanical parts of the invention.

Referring now to the drawings wherein the showings are made for the purposes of illustrating a preferred embodiment of the invention only and not for the purpose of limiting same, FIG. 1 shows the mechanical components of a fresh water and carbonated water system incorporating the present invention as used in an otherwise conventional beverage dispensing unit. Beverage dispensing units are well known in the art and available commercially from a number of sources including Wilshire, the assignee of the present application. Such beverage dispensers have been fully described previously in patents and other publications and will not be described in detail herein.

Water is received from city water or the like at a main water supply 10 maintained at pressure typically near 40 lb/in$^2$. A water pump 12 receives water from the main water supply at its inlet 14. When the pump is energized, high pressure water is provided at the pump outlet 16. The high pressure water flows through a plain water pre-chill coil 18 through a check valve 20, an orifice 22 and into the body of carbonator tank 24. If the unit is mechanically refrigerated the pre-chill coil 18 and carbonator tank 24 are immersed in a water bath 25 (shown schematically). The water bath is kept cold by an evaporator (not shown) upon which an ice bank is formed. The pre-chilled water enters the carbonator tank at high velocity because of the small orifice thereby causing turbulence and intimate mixing of carbon dioxide bubbles in the body of water contained within the tank aiding carbonation. The water must be under high pressure entering the carbonator tank as the carbonator tank is maintained at high pressure so that the carbon dioxide gas will go into solution. Typically, the carbonator tank is kept at a pressure of about 75 lbs/in$^2$. The output pressure of the water pump 12 must be higher than the nominal pressure of the carbonator tank as pressure losses occur in the pre-chill coil 18, the check valve 20 and the orifice 22. Typical pump output pressure rise is 120–170 lbs/in$^2$ depending in large part on the flow restriction imparted by the orifice 22. If flow is fully restricted, the pump pressure rise may increase to as high as 170–250 lbs/in$^2$ depending on the pump design.

Carbon dioxide is introduced into the carbonator 24 through a carbon dioxide supply line 26 and a check valve 28 at about 75 lbs/in$^2$. Carbonated water from the carbonator 24 flows through carbonated water lines 30 to carbonated beverage dispensing valves 32 upon demand. When such demand causes the level of carbonated water in the carbonator 24 to drop below a selected level, a water level sensor 34 sends a signal to a liquid level controller (not shown) which actuates a motor driving the pump 12 to refill the carbonator tank 24 with water. The pump 12 operates at a pressure sufficiently high to charge the tank 24 to a selected high level whereupon the sensor 34 sends another signal and the motor driving the pump 12 is turned off. Thus, the dispensing of a carbonated drink is facilitated regardless of inlet pressure at the main water supply 10. Conventionally, plain water drinks were provided by allowing water to flow through the deenergized pump 12 through the pre-chill coil 18 and to one of the plain water dispensing valves 40. The pressure and flow rate provided to the plain water dispensing valves was limited by the restrictions and losses in the pump 12, the pre-chill coil 18 and the delivery lines.

As can be seen in FIG. 1, in the present invention, a plain water line 42 connects the output of the pre-chill coil 18 to the plain water dispensing valves 40. The plain water dispensing valves 40 are identical to one another. They may be provided with different flavoring syrup to provide different drinks, but with respect to water flow, they are identical. Three plain water valves 40 and six carbonated water dispensing valves 32 are shown in FIG. 1. Other combinations of valves may be provided. Each valve 40 is electrically operated by a solenoid 44. The solenoid is typically operated by a manually actuated momentary contact switch 41 on the body of the valve itself. Such a switch 41 and its location is conventional. The switch 41, when depressed, provides current to the solenoid which physically opens the plain water dispensing valve allowing water and, if desired, flavoring syrup, to be dispensed. FIG. 1 schematically shows one valve 40 to meter the dispensed plain water. Another valve for dispensing syrup parallel with each water valve and connected to a separate syrup supply is not shown but forms a part of each dispensing valve, as is conventional.

In prior art devices, water would then flow through the water pump 12, the pre-chill coil 18, the plain water supply line 42 and the actuated valve 40. Applicant has found that when more than one plain water dispensing valves 40 is operated at once, reduced water flow and low pressure to the valves 40 often results. Applicant found that the primary restriction impeding water flow is the inactive water pump 12. The pressure drop across a typical inactive pump 12 is 25 lb/in$^2$ at a 2.5 oz/sec, typical of the desired flow rate dispensed from one valve. In the present invention, the pressure drop and restriction caused by the inactive pump 12 is avoided. A high flow rate, low pressure drop bypass valve 72 is connected parallel to the pump 12. The inlet of the check valve 72 is connected to the inlet of the pump 12 and the output of the check valve 72 is connected to the outlet of the pump 12. The check valve 72 allows water to flow around the pump 12 to the pre-chill coil 18 and thence to the plain water dispensing valves 40. Adequate water flow at appropriate pressure is provided.

The operation of the check valve 72 is completely automatic and does not interfere with the normal operation of the pump 12 and carbonator 24. When the pump 12 is activated, pressure increases at the outlet of the check valve 72 and the check valve 72 closes. Full pump output is applied to the carbonator 24.

Alternatively, a high flow rate solenoid valve 74 may be connected parallel to the pump 12 in place of the check valve 72. The solenoid valve 74 is opened when a plain water beverage dispensing switch 41 operating one of the solenoids 44 is actuated via an electrical control circuit not shown. The valve 74 bypasses the pump 12 allowing water to flow from the main water supply 10 through the pre-chill coil 18 to the dispensing valves 40. The restriction of the water pump 12 is avoided. When plain water beverages are not being dispensed, all of the switches operating the solenoids 44 are open and the solenoid valve 74 is closed, preventing the flow of water around the pump 12. The pump 12 can then be used in the conventional way to charge the carbonator 24.

When the carbonator 24 requires charging with water, the pump 12 is turned on. If this occurs while a plain water beverage is being dispensed from one of the valves 40, the solenoid valve 74 will be in the open state. A portion of the output of the pump 12 will flow back to the main water supply 10 and the output pressure of the pump will be significantly reduced. This prevents dispensing through the valves 40 at too high a pressure or flow rate. With solenoid valve 74 open, the carbonator tank will not fill because the output pressure to the pump would not be high enough to overcome the higher pressure contained within the tank plus the flow restriction imposed by the inlet check valve 20 and inlet orifice 22. When plain water dispensing from valves 40 is stopped, bypass valve 74 will close and output pressure from pump 12 will rise to a level sufficient to again pump water into carbonator tank 24. During plain water dispensing from valves 40, simultaneous carbonated drink dispensed from valves 32 would be provided by the reserve carbonated water volume stored in carbonator tank 24.

The invention has been described with reference to a preferred embodiment. Obviously, modifications and alterations as described above and otherwise will occur to others upon a reading and understanding of this specification and it is intended to include such modifications and alterations insofar as they come within the scope of the appended claims or their equivalents.

Having thus defined the invention, it is claimed:

1. In a water circuit of a combined carbonated and non-carbonated beverage dispenser having: a carbonator; a water pump outside said carbonator adapted to supply high pressure water to said carbonator with an inlet, an outlet and a nominal outlet pressure; at least one carbonated beverage dispensing valve adapted to receive water from said carbonator; and, at least one non-carbonated beverage dispensing valve, the improvement comprising:

a bypass line directly connected between said pump inlet and said pump outlet; and, a bypass valve in said bypass line.

2. The improvement of claim 1 wherein said bypass valve is a high flow capacity check valve permitting bypass flow from said pump inlet to said pump outlet only.

3. The improvement of claim 1 wherein said bypass valve is a solenoid actuated bypass valve and said at least one non-carbonated beverage dispensing valve has an electrical beverage dispensing switch, said switch adapted to actuate said dispensing valve and said solenoid actuated bypass valve.

4. The improvement of claim 3 wherein said solenoid actuated bypass valve allows flow through bypass valve from said pump inlet to said pump outlet and said pump outlet to said pump inlet when said beverage dispensing switch is actuated whereby.

5. The improvement of claim 1 wherein a pre-chill coil receives water from said pump and said bypass line and provides water to said at least one non-carbonated dispensing valve and said carbonator.

6. A combined carbonated and non-carbonated beverage dispenser comprising:

a water supply line receiving water from a source of water;

a carbonator;

a water pump outside said carbonator having an inlet and an outlet, said water pump inlet being connected to said water supply line;

said carbonator receiving water from said pump outlet;

at least one carbonated beverage dispensing valve receiving carbonated water from said carbonator;

at least one non-carbonated beverage dispensing valve receiving water from said pump outlet;

a bypass line carrying water from said water supply line directly to the outlet of said pump; and, a bypass valve controlling flow of water in said bypass line.

7. The beverage dispenser of claim 6 wherein said bypass valve is a check valve allowing flow of water from said water supply line to the outlet of said pump only.

8. The beverage dispenser of claim 7 further comprising a water chilling coil receiving water from said pump outlet and said bypass line and providing water to said carbonator and said at least one non-carbonated beverage dispensing valve.

9. The beverage dispenser of claim 6 wherein said at least one non-carbonated beverage dispensing valve includes an electrical switch actuating said dispensing valve; said bypass valve is a normally closed solenoid actuated bypass valve; and, said non-carbonated beverage dispensing switch actuates said bypass valve.

10. The beverage dispenser of claim 9 further comprising a water chilling coil receiving water from said pump outlet and said bypass line and providing water to said carbonator and said at least one non-carbonated beverage dispensing valve.

* * * * *